US005697613A

United States Patent [19]

Merino et al.

[11] Patent Number: 5,697,613

[45] Date of Patent: Dec. 16, 1997

[54] DEVICE FOR PROPELLING GAME BALL

[75] Inventors: Darrell Merino, Newburyport, Mass.; Dwayne Carr, Sandown, N.H.; Randall Moormann, Georgetown, Mass.

[73] Assignee: Hasbro, Inc., Pawtucket, R.I.

[21] Appl. No.: 537,493

[22] Filed: Oct. 2, 1995

[51] Int. Cl.[6] ..... A63F 7/22

[52] U.S. Cl. ..... 273/129 W; 273/108.2

[58] Field of Search ..... 273/129 R, 129 V, 273/129 W, 108.1, 108.2, 108.54; 473/131; 124/16, 79

[56] References Cited

U.S. PATENT DOCUMENTS

| | | | |
|---|---|---|---|
| 454,603 | 6/1891 | Phillips . | |
| 905,586 | 12/1908 | Rigney . | |
| 1,308,201 | 7/1919 | Smith . | |
| 1,678,527 | 7/1928 | Payne | 124/79 |
| 1,763,205 | 6/1930 | Winbigler . | |
| 2,170,373 | 8/1939 | Kind . | |
| 2,722,211 | 11/1955 | Eisele | 124/16 |
| 3,051,487 | 8/1962 | Miller | 273/129 W |
| 3,091,465 | 5/1963 | Ogdon | 273/129 W |
| 3,190,653 | 6/1965 | Karthaus | 273/129 W |
| 3,469,846 | 9/1969 | Lippert | 273/129 W |
| 3,598,411 | 8/1971 | Lippert | 273/129 W |
| 4,333,651 | 6/1982 | Ingels . | |
| 4,416,247 | 11/1983 | Yoshida . | |
| 4,488,723 | 12/1984 | LaGrow | 273/129 W X |

*Primary Examiner*—Raleigh W. Chiu
*Attorney, Agent, or Firm*—Kurt R. Benson

[57] ABSTRACT

A device for propelling a game ball on a game surface includes an actuator arm which is manually depressible with a finger of a user for pivoting a pivot arm to engage the game ball and to thereby propel it on the game surface. The device further includes a restricting housing which extends around the actuator arm for limiting the degree of finger movement in a direction away from the actuator arm and for thereby limiting the amount of momentum which can be imparted to the pivot arm with the actuator arm.

5 Claims, 3 Drawing Sheets

DEVICE FOR PROPELLING GAME BALL

BACKGROUND AND SUMMARY OF THE INVENTION

The instant invention relates to parlor games and more particularly to a device for use in a game in which a game player is required to propel a game ball on a playing surface.

The game of miniature golf has generally been found to have a relatively high level of appeal. Further, parlor games which incorporate miniature golfing themes have also been found to have high levels of appeal. However, most of the heretofore available parlor games which have been adapted for use in playing simulated miniature golfing games have included relatively crude and ineffective ball striking devices which have not been effectively capable of simulating actual miniature golf swinging operations. Hence, the heretofore available parlor games which have been adapted to incorporate miniature golfing themes have generally been ineffective for realistically simulating actual miniature golfing game play.

The heretofore available ball striking or propelling devices representing the closest prior art to the subject invention of which the applicant is aware are disclosed in the Phillips U.S. Pat. No. 454,603; Rigney No. 905,586; Smith No. 1,308,201; Winbigler No. 1,763,205; Kind No. 2,170,373; Ingles No. 4,333,651; and Yoshida No. 4,416,247. However, while these references disclose a variety of ball striking devices, they fail to teach a ball striking device which is operative with a realistic simulated golf swing action, and hence, they are believed to be of only general interest to the subject invention.

The instant invention provides an effective device for propelling a game ball, such as a miniaturized golf ball, on a playing surface during the course of a simulated miniature golf game. In this regard, the device of the instant invention comprises a pivot arm, a base for pivotally mounting and supporting the pivot arm above a game surface, and an actuator for pivoting the pivot arm in a manner which enables the pivot arm to be utilized for engaging and propelling a game ball on a game surface. The actuator is preferably adapted so that it is manually operable with a finger of an operator for causing it to pivot the pivot arm, and the device further comprises a restricting housing which extends around the actuator for restricting the movement of a finger of an operator in a direction away from the actuator in order to thereby restrict the amount of momentum which can be transferred to the pivot arm during a pivoting operation. The device preferably includes a spring for biasing the pivot arm toward a downwardly extending rest position, and the actuator arm is preferably integrally formed with the pivot arm so that it extends outwardly in angular relation therefrom. More specifically, the actuator arm preferably extends outwardly in a substantially horizontal disposition when the pivot arm is in the rest position so that the actuator arm is manually depressible in a downward direction with a finger of an operator for pivoting the pivot arm to propel a game ball. The base portion of the device preferably includes pair of forwardly extending legs which are receivable on a supporting surface and define an open guide slot therebetween for receiving a game ball. The pivot arm is preferably positioned so that it is operative for engaging a game ball received in the guide slot for propelling the game ball along a supporting surface as the pivot arm is pivoted from the rest position thereof.

It has been found that the device of the subject invention can be effectively utilized in a parlor game of the general type in which game players propel one or more game balls on a game surface. However, it has been found that the device is particularly effective for use in a game which is adapted to simulate a miniature golf game. In this regard, the device of the instant invention includes a pivot arm which is adapted so that it can effectively function as a miniature golf club for striking a miniature golf ball during the course of game play. Further, the device includes a restricting housing which extends around the actuator arm in order to limit the amount of momentum which can be transferred to the pivot arm during a pivoting operation. As a result, the device is better adapted for game play on a restricted game surface area, and it is adapted to enable users to more skillfully advance their game balls during the course of game play.

Accordingly, it is a primary object of the instant invention to provide an effective device for propelling a game ball in a simulated miniature golfing game.

Another object of the instant invention is to provide an effective device for propelling a game ball in a parlor game.

Still another object of the instant invention is to provide an effective device for propelling a game ball which includes a restrictive housing for restricting the amount of momentum which can be transferred to the game ball during a ball striking operation.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
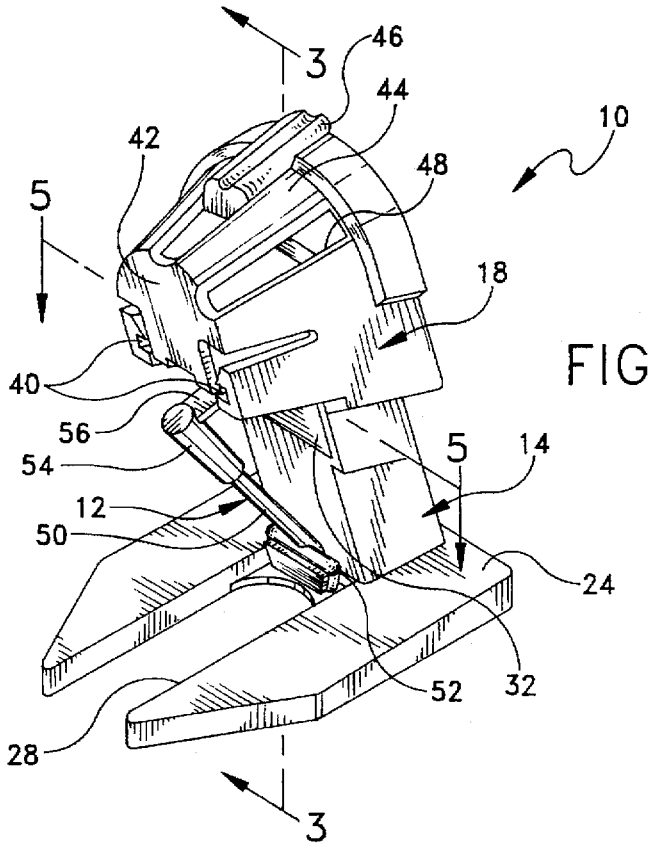
FIG. 1 is a perspective view of device of the instant invention.
Figure 2:
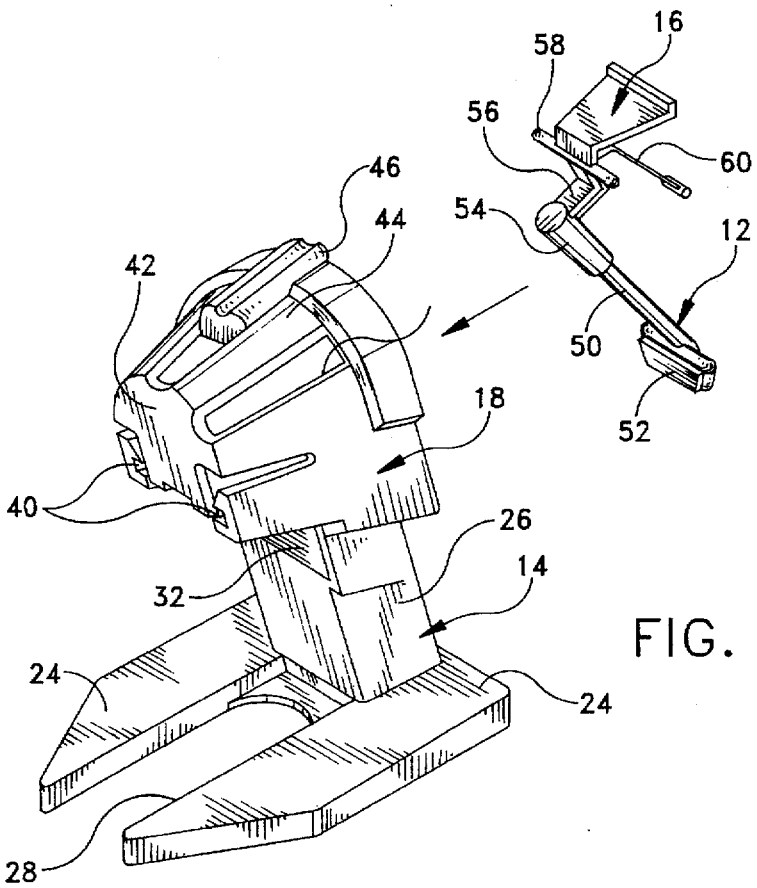
FIG. 2 is an exploded perspective view thereof.

Referring now to the drawings, the device of the instant invention is illustrated and generally indicated at 10 in FIGS. 1–6. The device 10 includes a pivot arm generally indicated at 12, a base generally indicated at 14, an actuator generally indicated at 16, and a restricting housing generally indicated at 18. The actuator 16 is integrally formed with the pivot arm 12, and the restricting housing 18 is integrally formed with the base 14. The pivot arm 12 and the actuator arm 16 are pivotally mounted in the base 14 so that the actuator arm 16 is manually depressible in the manner illustrated in FIGS. 4 and 6 for propelling a ball 20 along a game surface. The restricting housing 18 is operative for providing an enclosure which extends around the actuator arm 16 in order to restrict the movement of a finger 22 of an operator during use of the device 10 in a manner which limits the amount of momentum which can be transferred to the pivot arm 12 with the finger 22.

Figure 3:
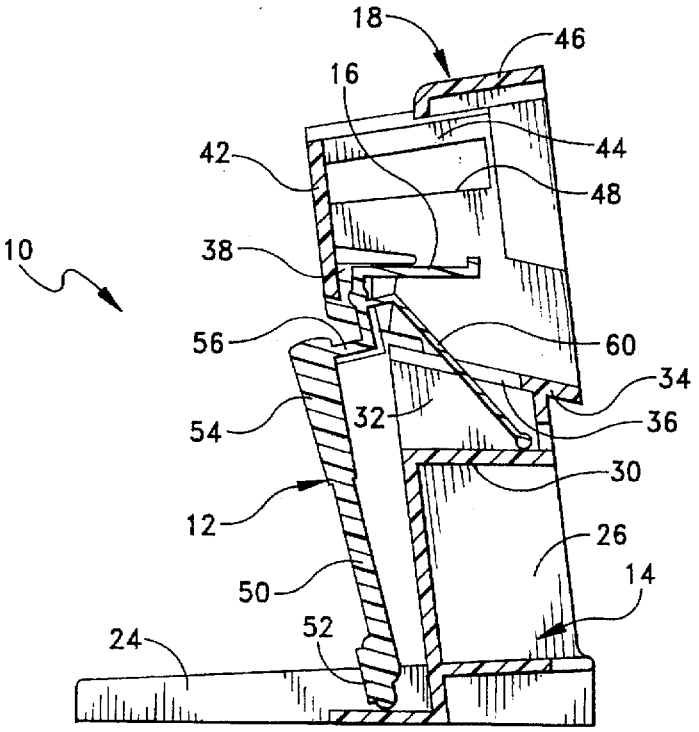
FIG. 3 is a sectional view taken along line 3—3 in FIG. 1.
Figure 4:
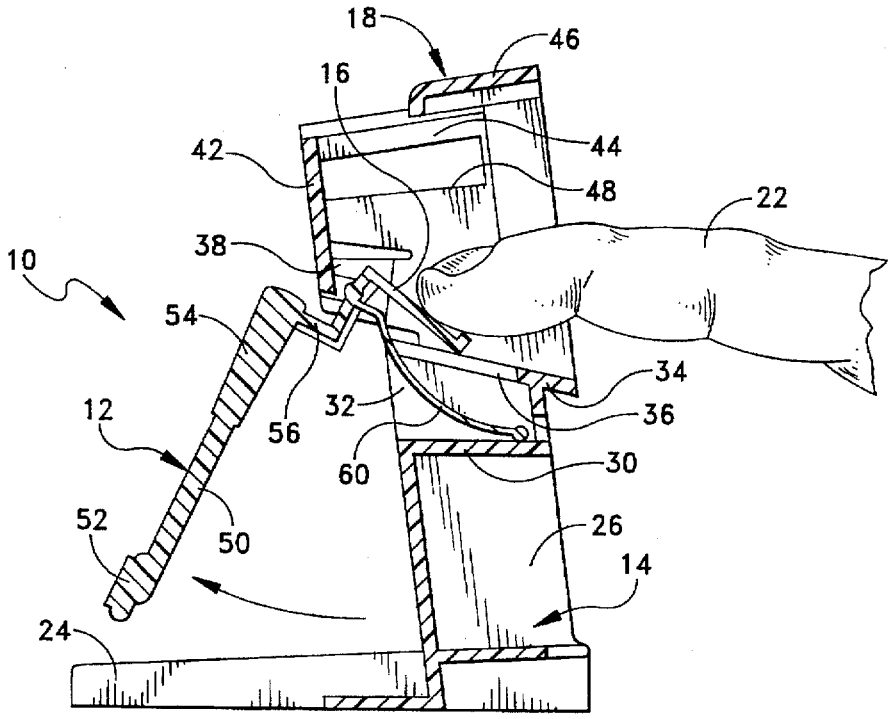
FIG. 4 is a similar sectional view as the device is operated by a user.
Figure 5:
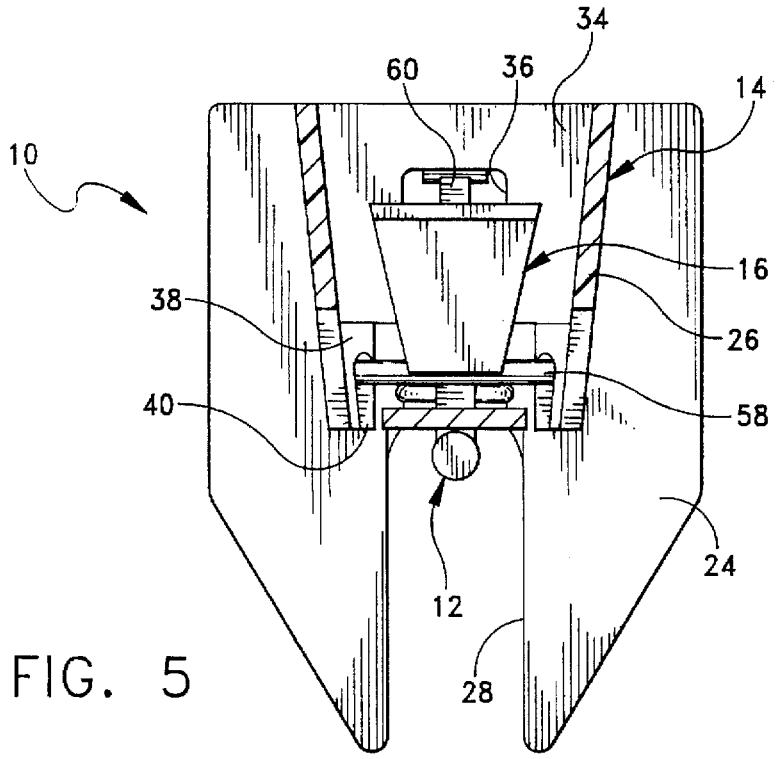
FIG. 5 is a sectional view taken along line 5—5 in FIG. 1.
Figure 6:
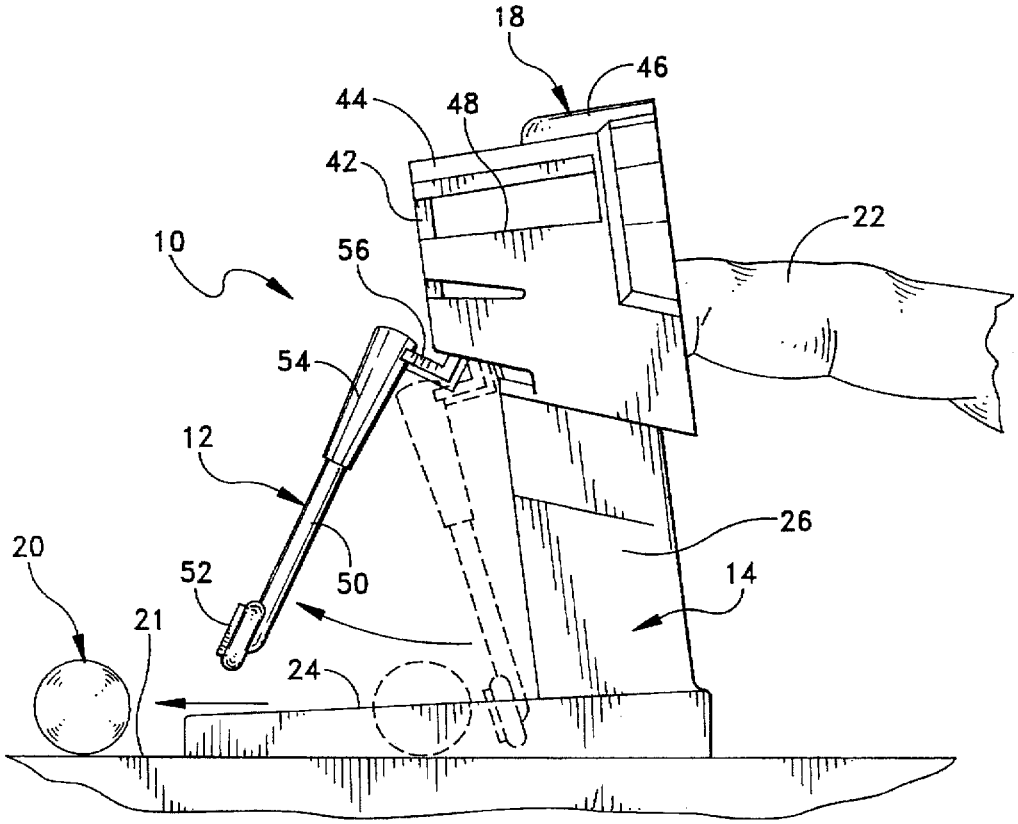
FIG. 6 is a side elevational view of the device as it is operated by a user.

The base 14 is preferably integrally molded from a suitable plastic material with the restricting housing 18. The base 14 includes a pair of leg portions 24 which extend forwardly from a pedestal portion 26. The leg portions 24 cooperate to define a guide slot 28 therebetween which is dimensioned for receiving the ball 20 therein so as to guide the ball 20 in its forward movement away from the pedestal portion 26 when the ball 20 is contacted by the pivot arm 12. As illustrated in FIGS. 3 and 4, the pedestal portion 26 includes a generally horizontal upper support wall 30 for defining the lower extremity of a forwardly opening cavity 32 in the pedestal portion 26. The upper extremity of the cavity 32 is defined by an angular wall 34 having an opening 36 therein, and a pair of pivot mounts 38 are provided just above the angular wall 34. The pivot mounts 38 open outwardly through forwardly opening slots 40 which are adapted for mounting the assembly comprising the pivot arm 12 and the actuator arm 16 on the base 14 in a manner which will hereinafter be more fully set forth.

Extending integrally upwardly from the base 14 is the restricting housing 18 which is adapted for receiving a finger 22 of an operator therein from the rear side of the device 10. The restricting housing 18 is formed as a generally rounded forwardly tapering open housing element that includes a front wall 42, a curved top and side wall portion 44, and an alignment sight 46. The top and side wall portion 44 has a plurality of openings 48 formed therein, and the alignment sight 46 is formed at the upper end of the housing 18 to provide an alignment sight for aiming the device 10 so that a ball 20 is projected in a desired direction. The housing 18 is, however, open at the rear end thereof for receiving a finger 22 therein.

The pivot arm 12 comprises an elongated shaft portion 50 having a lower contacting end portion 52 and an upper end 54 which is attached to a linkage arm 56 which extends to an integrally formed transverse pivot shaft 58. Also formed integrally with the pivot arm 12 is a biasing spring portion 60 which extends rearwardly from the pivot shaft 58, and the actuator arm 16 extends integrally upwardly and rearwardly from the pivot shaft 58. Accordingly, the actuator arm 16 is disposed in approximately perpendicular relation to the shaft portion 50 so that when the shaft portion 50 is in a generally vertical disposition, the actuator arm 16 is in a generally horizontal disposition. The pivot arm 12 and the actuator arm 16 are, however, pivotable as a unit about the axis of the pivot shaft 58. The pivot shaft 58 is received in the pivot mounts 38 in the manner illustrated in FIGS. 3 and 4 so that the spring element 60 engages the wall 30 for biasing the pivot arm 12 to the position illustrated in FIG. 3. However, as illustrated in FIG. 4, by pressing downwardly on the actuator arm 16, the pivot arm 12 can be pivoted forwardly against the bias of the spring element 60 for propelling a ball 20 from the device 10.

Accordingly, for use and operation of the device 10, a ball 20 is placed at the rear end of the guide slot 28 so that it is positioned in front of the contact end portion 52 of the pivot arm 12. A finger 22 of an operator is then inserted into the restricting housing 18 so that the finger 22 is placed in contact with the actuator arm 16. Thereafter, the actuator arm 16 can be depressed for pivoting the pivot arm 12 so as to propel the ball 20 in a forward direction through the guide slot 28 between the legs 24. As the actuator arm 16 is depressed in this manner, the pivot arm 12 is rapidly pivoted forwardly about the axis of the pivot shaft 58, and the spring 60 operates to bias the pivot arm 12 to return it to the rest position illustrated in FIGS. 1 and 3. As the device 10 is operated in this manner, the restricting housing 18 restricts the movement of the finger 22 so that the finger 22 can only be moved a relatively short distance upwardly from the actuator 16 when the pivot arm 12 is in the rest position thereof. As a result, the movement of the finger 22 in the housing 18 is significantly restricted, and the amount of momentum that can be imparted to the ball 20 by pivoting the pivot arm 12 with the actuator arm 16 is significantly restricted. This has the effect of making the pivot arm 12 function in a manner similar to a conventional golf putter by preventing excessive amounts of forward momentum from being imparted to the ball 12 therewith.

It is seen, therefore, that the instant invention provides an effective device for propelling a game ball along a game surface. The device 10 is particularly adapted for use in a parlor game having a miniature golf theme, although it could also be utilized in a variety of other games and game assemblies for propelling game balls on game surfaces. Device 10 is capable of controlled operation so that it can be effectively utilized for imparting a restricted mount of momentum to the game ball, and therefore, the device 10 is particularly effective for use in various board games. Accordingly, it is seen that the instant invention represents a significant advancement in the game art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claim.

What is claimed is:

1. A device for propelling a game ball on a playing surface comprising:

a pivot arm having a contact end;

a base for pivotally mounting said pivot and above said game surface so that said pivot arm is pivotable from a rest position in which it extends downwardly to said contact end thereof, said contact end passing in closely adjacent relation to said playing surface as said pivot arm is pivoted in a forward direction from the rest position thereof;

an actuator arm manually engageable by a finger of an operator for causing said pivot arm to be pivoted in a forward direction from the rest position thereof, said actuator arm being integrally formed in a one-piece construction with said pivot arm and extending angularly therefrom; and restricting means for restricting the degree of movement of the finger of an operator in a direction away from said actuator arm and for thereby restricting the amount of momentum transferred to said pivot arm during a forward pivoting operation.

2. The device of claim 1 further comprising spring means for biasing said pivot arm toward the rest position thereof.

3. In the device of claim 1, said restricting means comprising a restrictive housing extending around said actuator means for restricting the degree of movement of the finger of an operator.

4. A device for propelling a game ball on a playing surface comprising:

a pivot arm having a contact end;

a base for pivotaly mounting said pivot arm above said game surface so that said pivot arm is pivotable from a rest position in which it extends downwardly to said contact end thereof, said contact end passing in closely adjacent relation to said playing surface as said pivot arm is pivoted in a forward direction from the rest position thereof;

an actuator arm manually engageable by a finger of an operator for causing said pivot arm to be pivoted in a forward direction from the rest position thereof, said actuator arm extending substantially horizontally outwardly from said pivot arm when said device is received on a horizontal game surface and said pivot arm is in the rest position thereof, said actuator arm being manually depressible in a downward direction by a finger of an operator for pivoting said pivot arm in a forward direction from the rest position thereof; and restricting means for restricting the degree of movement of the finger of an operator in a direction away from said actuator arm and for thereby restricting the amount of momentum transferred to said pivot arm during a forward pivoting operation.

5. A device for propelling a game ball on a playing surface comprising:

a pivot arm having a contact end;

a base for pivotally mounting said pivot arm above said game surface so that said pivot arm is pivotable from a rest position in which it extends downwardly to said contact end thereof, said contact end passing in closely adjacent relation to said playing surface as said pivot arm is pivoted in a forward direction from the rest position thereof, said base including a pair of forwardly extending legs which are receivable on a supporting surface and define an open guide slot therebetween for receiving the game ball, said contact end traveling in said guide slot for engaging the game ball when said pivot arm is pivoted in a forward direction from the rest position thereof;

an actuator arm manually engageable by a finger of an operator for causing said pivot arm to be pivoted in a forward direction from the rest position thereof; and restricting means for restricting the degree of movement of the finger of an operator in a direction away from said actuator arm and for thereby restricting the amount of momentum transferred to said pivot arm during a forward pivoting operation.

* * * * *